US005388986A

United States Patent [19]

Khemarangsan

[11] Patent Number: 5,388,986

[45] Date of Patent: Feb. 14, 1995

[54] CIGARETTE GAS LIGHTER

[75] Inventor: Decha Khemarangsan, Samutsakorn, Thailand

[73] Assignee: Thai Merry Co., Ltd., Samutsakorn, Thailand

[21] Appl. No.: 29,178

[22] Filed: Mar. 10, 1993

[30] Foreign Application Priority Data

Mar. 18, 1992 [EP] European Pat. Off. ..... 92104684

[51] Int. Cl.[6] ..... F23D 14/28

[52] U.S. Cl. ..... 431/344; 431/206; 431/243

[58] Field of Search ..... 431/243, 344, 143, 206, 431/254, 255, 256

[56] References Cited

U.S. PATENT DOCUMENTS 4,289,478 9/1981 Nitta ..... 431/344
4,484,888 11/1984 Grosslord ..... 431/344

FOREIGN PATENT DOCUMENTS 1063414 8/1959 Germany ..... 431/254

*Primary Examiner*—James C. Yeung
*Attorney, Agent, or Firm*—Burgess, Ryan & Wayne

[57] ABSTRACT

A gas lighter having a tank made of a synthetic resin, a burner including a nozzle and a wick member wherein the nozzle has a lower side portion containing a porous member and a through hole therein, And a metal heat collecting member extending into the tank and having a projection inserted in the through bole of the porous member.

5 Claims, 2 Drawing Sheets

CIGARETTE GAS LIGHTER

BACKGROUND OF THE INVENTION

I. Field of the Invention

The present invention relates to a cigarette gas lighter in which a tank for storing liquefied gas fuel is made of a synthetic resin and, more particularly, to an improvement in arrangement of a burner member provided to the tank.

II. Description of the Prior Art

Conventionally, the tank in a gas lighter for storing liquefied gas fuel is often made of a synthetic resin in order to reduce the weight and the cost of the lighter.

Japanese Patent Publication No. 57-32304 and U.S. Pat. No. 4,289,478, disclose cigarette lighters having tanks made of a synthetic resin. In these lighters, the region around the burner is also made of a synthetic resin and the thermal conductivity of this portion of the lighter is therefore lower than that compared to a metal burner. As a result, the heat of vaporization required for vaporizing the liquefied gas fuel in the burner is insufficient. Thus, vaporization of the fuel is not sufficiently performed in the burner, and liquid fuel tends to be present in the burner.

If the liquefied gas fuel is present in the burner, even when a predetermined amount of fuel is drawn up by the wick extending into the tank, the amount of vaporization is inconsistent and thus the gasified fuel injected from a gas jet nozzle of the burner is unstable. As a result, the length of the flame of the lighter is inconsistent. In addition, fuel may be sometimes injected from the nozzle in the form of a non-gasified liquid. An inconsistent length of flame and external injection of the liquefied gas can endanger the user.

Japanese Patent Publication No. 57-32304 discloses a lighter in which the heat of the liquefied gas fuel used is conducted to the pin disk of the burner to supply a sufficient amount of heat of vaporization to the passage of the liquefied gas fuel between the pin disk and the nozzle bottom to prevent the temperature therearound from rapidly falling. An upper end face of the heat collecting tube extending into the tank contacts the pin disk to conduct the heat of the liquefied gas to the pin disk through the heat collecting tube.

However, in the above-referenced cigarette gas lighter, since the metal pin disk and the metal heat collecting tubes are separate members and the lower surface of the pin disk is brought into contact with the upper surface of the heat collecting tube, the distance between these upper and lower surfaces tends to be inconsistent depending on the degree of surface roughnesses of the lower and upper surfaces and the variation in size of the various members provided to the burner. This inconsistency in distance renders the heat conducting properties between the upper and lower surfaces unstable and thus may adversely affect vaporization of the liquefied gas fuel.

SUMMARY OF THE INVENTION

It is a main object of the present invention to provide a cigarette gas lighter in which vaporization of the liquefied gas fuel in a burner is improved and the number of components of the lighter reduced.

In order to achieve the above objects, according to the present invention, there is provided a cigarette gas lighter comprising a tank made of a synthetic resin for storing liquefied gas fuel, a burner member, having a gas injecting nozzle member and a wick member suspended in the tank for absorbing the liquefied gas fuel, and fixed in a receiving recess formed in the tank, and ignition means for igniting the gasified fuel injected from the nozzle member, wherein a lower portion of a metal heat collecting member integrally formed with a projection at an upper end portion thereof is made as a tubular portion or a rod-shaped portion, the tubular portion or the rod-shaped portion extending into the tank either outside or inside the wick member and the projection is inserted in a through hole formed in a lower side portion of the nozzle member through a porous member disposed in a lower portion of the nozzle member.

In the cigarette gas lighter having the above arrangement, since the heat of the liquefied gas fuel is directly, reliably, and consistently conducted from the metal heat collecting member provided to the wick member to the projection integrally formed with the heat collecting member at the lower portion of the nozzle member, heat is sufficiently supplied, and vaporization of the liquefied gas fuel is sufficiently performed. Since the heat collecting member and the projection of the lower portion of the nozzle member are integrally formed, the number of components of the lighter is less than the number of components of a conventional cigarette gas lighter. As a result, the assembly and parts management of the lighter during manufacturing is improved.

Since the fuel through hole is formed in the tubular portion of the heat collecting member perpendicular to the axis of the nozzle, the liquefied gas fuel is not directly supplied to the lower portion of the nozzle member. Instead the fuel reaches the lower portion of the nozzle member through the gap between the side portion of the tubular portion and the porous member, and hence the length of the passage of the liquefied gas fuel is increased to allow sufficient vaporization.

Since the wick member is inserted in and formed by the tubular member, part of the wick member is also present in the fuel through hole communicating with the interior of the tubular member. Thus, the wick member is firmly fixed on the tubular member without being removed from the tubular portion.

The above and other objects, arrangements, and features of the present invention will become apparent from the detailed description of the embodiments of the present invention in conjunction with the accompanying drawings.

DETAILED DESCRIPTION OF THE INVENTION

Figure 1:
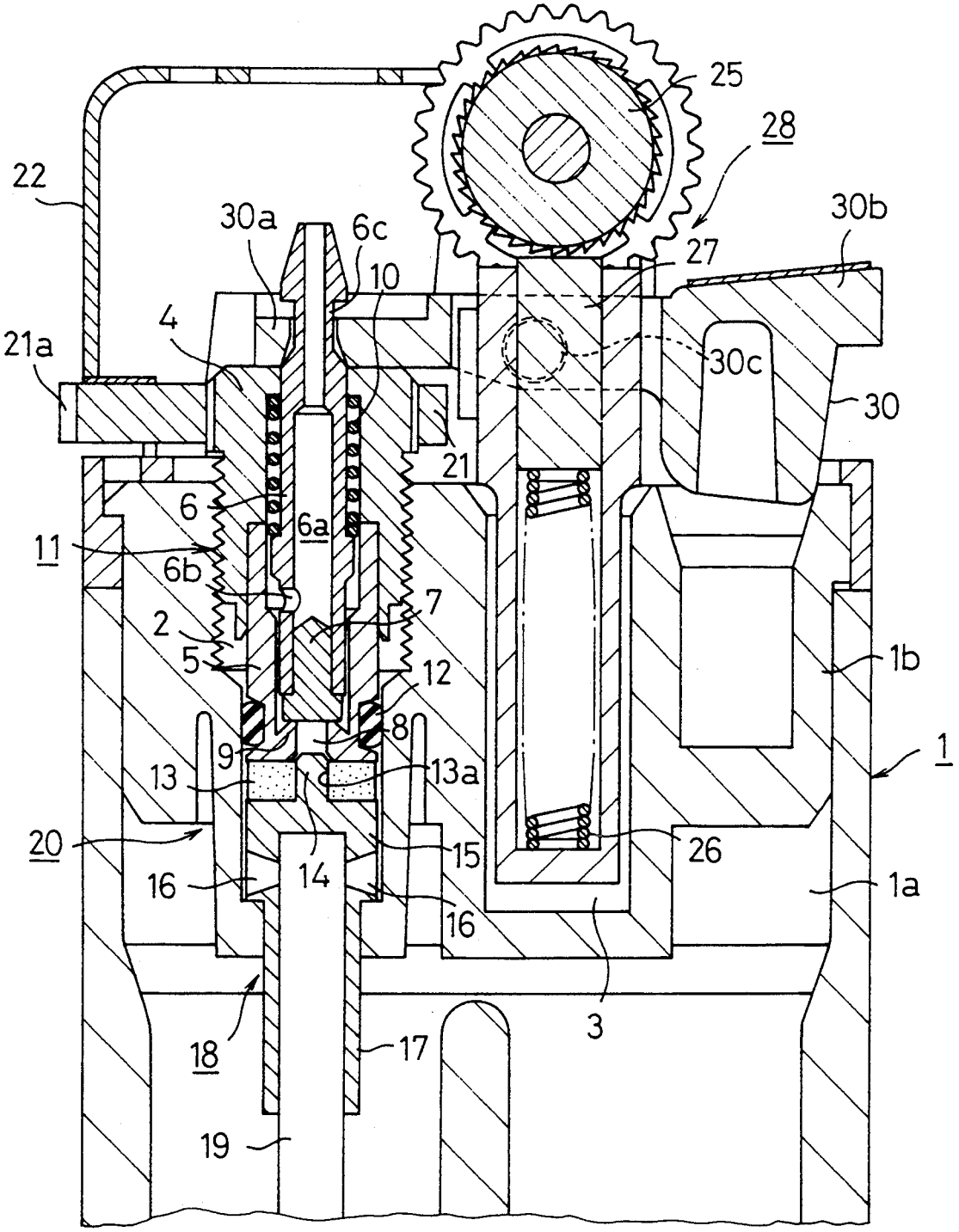
FIG. 1 is a front sectional view of a cigarette gas lighter according to a first embodiment of the present invention.

Referring to FIG. 1, a fuel tank 1 includes a container portion 1*a* made of a synthetic resin for storing known liquefied gas fuel and a lid 1*b* for sealing the upper opening of the container portion 1*a*. A first receiving recess 2 for storing a burner member (to be described later) and a second receiving recess 3 for storing a lighting means are formed in the lid 1*b*.

A nozzle member 11 having outer and inner tubes 4 and 5 respectively a gas jet nozzle 6, a valve packing 7, a valve seat 9, and a spring 10 is screwed in the upper portion of the first receiving recess 2 to be vertically movable while its side portion is sealed by an annular packing 12. The inner tube 5 is fitted in the lower portion of the outer tube 4. The gas jet nozzle 6 is housed in a tubular member consisting of the outer and inner tubes 4 and 5 to be vertically movable, and a side hole 6*b*, for causing the interior of the tubular member to communicate with a central hole 6*a*, is formed in the gas jet nozzle 6. The valve packing 7 is fixed to the lower end of the nozzle 6. The valve seat 9 is provided at the bottom portion of the inner tube 5, and a through hole 8 which is closed and opened by the valve packing 7 is formed in the valve seat 9. The spring 10 biases the nozzle 6 in a direction to close the through hole 8 with the valve packing 7.

In the lower portion of the first receiving recess 2, an annular porous member 13 is disposed on the bottom surface of the valve seat 9 of the inner tube 5, and a metal tubular heat collecting member 18 is disposed. A projection 14 is formed at the upper end portion of the heat collecting member 18, fuel through holes 16 are formed in an upper large-diameter portion 15 of the heat collecting member 18 in a direction perpendicular to the axis of the nozzle 11, and a tubular portion 17 is formed at the lower portion of the heat collecting member 18, as shown in the sectional view of FIG. 2. The upper portion of the projection 14 enters through hole 8 in the valve seat 9 through a hole 13*a* of the annular porous member 13 to clamp the annular porous member 13 with the upper large-diameter portion 15 and the outer bottom surface of the inner tube 5.

Figure 2:
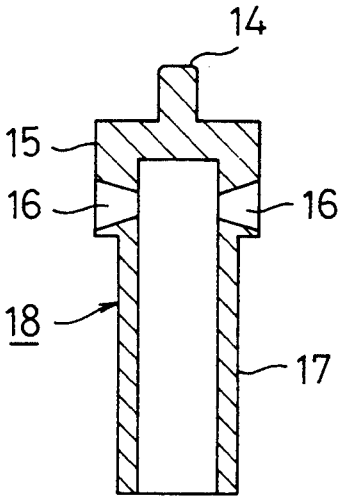
FIG. 2 is a sectional view of a heat collecting member of the cigarette gas lighter shown in FIG. 1.

The end portion of a wick member 19 suspending into the fuel tank 1 for drawing up the liquefied gas fuel is fixed to the tubular portion 17 of the tubular heat collecting member 18. A member having shaft-like shape may be inserted and fitted as the wick member 19 in the tubular portion 17 after the respective portions of the tubular heat collecting member 18 are formed as shown in FIG. 2.

Alternatively, a wick-forming mold (not shown) may be arranged in the tubular portion 17 and a known wick material may be inserted in the tubular portion 17 to form the wick member 19 by insertion formation. If the insertion formation is adopted, the wick member 19 extends from the interior of the tubular portion 17 to the fuel through holes 16, and the wick member 19 is reliably held by the tubular portion 17, thus preventing the wick member 19 from being removed.

As described above, a burner member 20, including the nozzle member 11, the porous member 13, the tubular heat collecting member 18, and the wick member 19,is mounted in the first receiving recess 2. A ring 21 having an operating projection 21*a* formed thereon is fitted on the outer tube 4 of the nozzle member 11. When the operating projection 21*a* is pivoted, the nozzle member 11 is vertically moved to adjust the fuel flow through the porous member 13. The distal end portion of the operating projection 21*a* projects from a windshield member 22 covering the distal end portion of the nozzle member 11 so that it can be externally operated.

A striker wheel 25 is rotatably supported in the second receiving recess 3, and a flint unit 28 having a flint 27 urged by a flint spring 26 and serving as a ignition means is fixed to the striker wheel 25.

An operating member 30, having one end 30*a* engaged with a small-diameter portion of the nozzle 6 of the nozzle member 11 and the other end forming a gas lever 30*b*, is rotatably supported on the flint unit 28 through a support shaft 30*c* at its central portion.

In the cigarette gas lighter described above, when the striker wheel 25 is rotated, a spark is generated by friction between the striker wheel 25 and the flint 27 and scattered around the nozzle 6 portion. At this time, when the gas lever 30*b* of the operating member 30 is depressed, the operating member 30 is pivoted about the support shaft 30*c* to lift the nozzle 6 by its one end 30*a*. When the nozzle 6 is moved upward against the biasing force of the spring 10, the through hole 8 which has been closed by the valve packing 7 is opened to set a valve-open state.

In the valve-open state, the liquefied gas fuel drawn up by the wick member 19 enters the first receiving recess 2 through the fuel through holes 16 of the tubular heat collecting member 18 and reaches the through hole 8 between the projection 14 of the tubular heat collecting member 18 and the valve seat 9 through the porous member 13. The liquefied gas fuel is gasified in the through hole 8. The gasified fuel enters the nozzle member 11 and is injected to the outside from the central hole 6*a* through the side hole 6*b* of the nozzle 6 and is ignited by heat of the spark.

The liquefied gas fuel is not supplied to the valve seat 9 of the nozzle member 11 directly. Rather, it flows to a side portion of the tubular heat collecting member 18 from the pair of fuel through holes 16 and passes through the gap between the first receiving recess 2 and the upper large-diameter portion 15 and the porous member 13 to reach the valve seat 9. Since the length of passage of the liquefied gas fuel is generally longer than in prior art lighters, maximum vaporization takes place during passage, thus performing stable and sufficient vaporization.

When the gas lever 30*b* of the operating member 30 is released, the nozzle 6 is moved downward as it is biased by the spring 10 to close the through hole 8 by the valve packing 7, thus stopping the supply of the liquefied gas fuel and extinguishing the flame.

Upon vaporization of the liquefied gas fuel described above, since the constituent members of the burner member 20 around the vaporizing unit are deprived of the heat of vaporization, the temperature of the valve seat 9 of the nozzle member 11 and that of the projection 14 of the tubular heat collecting member 18 are reduced. However, since external heat reaches the valve seat 9 and the heat of the liquefied gas fuel directly reaches the projection 14 from the wick member 19 and the tubular portion 17, the heat of vaporization is sufficiently supplied to these portions, and the liquefied gas fuel is sufficiently gasified. Hence, the amount of gasified fuel injected from the nozzle 9 is stabilized, thereby stabilizing the length of the flame and making the length of the flame consistent over repeated ignition. In this embodiment, since the mass of the upper large-diameter portion 15 of the tubular heat collecting member 18 including the projection 14 is large and the upper large-diameter portion 15 and the projection 14 are integrally formed without a gap, thermal efficiency is improved.

Figure 3:
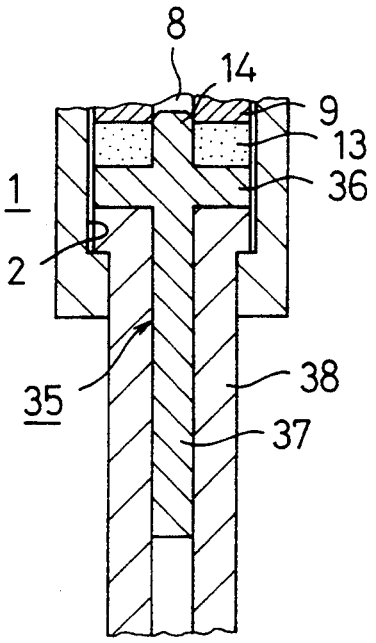
FIG. 3 is a sectional view showing a main part of a cigarette gas lighter according to a second embodiment of the present invention.

Referring to FIG. 3 there is shown a second embodiment of the present invention wherein a heat collecting member 35 has a shape different from that of its corresponding tubular heat collecting member 18 provided in the first receiving recess 2 of the fuel tank 1 of the first embodiment shown in FIGS. 1 and 2. In place of the tubular portion 17 of the tubular heat collecting member 18 of the first embodiment, a solid rod 37 is employed having an integrally formed large-diameter portion 36. The solid rod 37 is inserted and fixed in a wick member 38 for drawing up the liquefied gas fuel. A projection 14 is formed on the upper portion of the large-diameter portion 36 in the same manner as in the tubular heat collecting member 18 to partly extend into a through hole 8 of a valve seat 9 through a porous member 13.

In the embodiments described above, a flint type ignition means has been described. However, the ignition means is not limited to the arrangement shown in the drawings, and an electrical ignition means which generates a spark by utilizing a piezoelectric element or a cell and performs ignition can be used.

As has been described above, according to the present invention, the heat of the liquefied gas fuel can be directly supplied to the projection of the heat collecting member at the lower portion of the nozzle member, the heat vaporization required for vaporization of the liquefied gas fuel at this portion is sufficient supplied, and vaporization of the liquefied gas fuel is stably and reliably performed. As a result, the amount of gasified fuel injected from the nozzle member is stabilized, and thus the length of flame is consistent. Since the projection is integrally formed with the heat collecting member, the number of components is decreased, thus facilitating assembly and parts management.

What is claimed is:

1. A gas lighter comprising:

tank means for storing a liquefied gas fuel; burner means for burning the gas fuel stored in the tank means, said burner means including:

wick means for absorbing the liquefied gas fuel from the tank means, the wick means entering into the tank means, and the liquefied gas fuel being vaporized from the wick means to form a gasified fuel;

nozzle means for supplying the gasified fuel from the wick means at an ignition position and for closing the supply of gasified fuel at a closed position, the nozzle means being positioned after the wick means in the direction of flow of the fuel to an exit port, the nozzle means including a lower side portion and a porous member at the lower side portion, the porous member having a through hole therein;

ignition means for igniting the gasified fuel supplied to the exit port in the ignition position by the nozzle means, the ignition means being arranged adjacent the exit port when the nozzle means is in the ignition position;

metal heat collecting means for enhancing vaporization of the liquefied gas fuel from the wick means into the gasified fuel, the metal heat collecting means comprising a first portion extending into the tank means and cooperating with the wick means to form a gasified fuel and a second portion arranged adjacent the nozzle means, having a cylindrical shape and a diameter greater than the diameter of the first portion, a projection integrally formed at the second portion, the projection being inserted through the hole formed in the porous member, radial channels provided in the second portion to provide a flow of gas in a direction different from a direction of flow of the liquid into the first portion, so that the fuel passes from the second portion through a channel between the circumference of the second portion and an inside wall of the nozzle means;

the nozzle means having a valve means which is moved from the closed position to the ignition position by movement along an axis of the nozzle means, the valve means being seated on a valve seat when in the closed position, the valve means having a flow passage, with an actual direction, which passage is blocked at the valve seat, and an entry to the flow passage in a direction which is not parallel to the actual direction of the flow passage, at a position in a side of the valve means, after the blocked portion, in the direction of flow of the gas, the nozzle means having a passage between an outer circumference of the valve means and an inner wall of the nozzle means, whereby the fuel passes from the metal heat collecting means, through the porous member, through the valve means, through the passage between the outer circumference of the valve means and the inner wall of the nozzle means, through the entry to the flow passage and through the flow passage to the exit port in the valve means, when the lighter is in the ignition position.

2. The lighter according to claim 1 wherein the tank comprises a recess adapted fixedly to received the burner member.

3. The lighter according to claim 2 further comprising a tubular member formed at a lower portion of said heat collecting member for supporting the wick member.

4. The lighter according to claim 3, further comprising a radially extending through hole formed in a side portion of said tubular member for allowing the passage of fuel from the wick member through the tubular member.

5. The lighter of claim 1 wherein heat collecting member extends into said tank external to said wick member.

* * * * *